United States Patent [19]

Prill et al.

[11] 4,309,168

[45] Jan. 5, 1982

[54] SYSTEM FOR COMBINING MULTIPLE FUELS TO PRODUCE CONTROLLABLE GAS TEMPERATURES IN ASPHALT DRUM MIXERS

[75] Inventors: Fredric W. Prill, North Aurora; Lee V. Binz, Aurora, both of Ill.

[73] Assignee: Barber-Greene Company, Aurora, Ill.

[21] Appl. No.: 167,816

[22] Filed: Jul. 14, 1980

Related U.S. Application Data

[63] Continuation-in-part of Ser. No. 127,643, Mar. 6, 1980.

[51] Int. Cl.[3] ..... F27D 7/00; F27B 9/40

[52] U.S. Cl. ..... 432/24; 431/12; 432/37

[58] Field of Search ..... 431/12, 90; 432/24, 432/37, 105

[56] References Cited

U.S. PATENT DOCUMENTS

| | | | |
|---|---|---|---|
| 3,437,325 | 4/1969 | Putnam et al. | 432/37 |
| 4,025,057 | 5/1977 | Shearer | 366/11 |
| 4,143,972 | 3/1979 | Benson | 366/233 |
| 4,144,997 | 3/1979 | Anderson et al. | 431/90 |

*Primary Examiner*—John J. Camby

*Attorney, Agent, or Firm*—McDougall, Hersh & Scott

[57] ABSTRACT

An apparatus which monitors and controls the mass flow rates of two or more fuels and air is connected to a burner of a conventional asphalt drum mixer. Several fuels are combined and ignited to produce predictable burner temperatures. In this manner, fuels which ordinarily burn inefficiently can be used in conjunction with other more combustible fuels to produce hot mix asphalt. The regulation of the total fuel to air ratio results in controlled combustion which reduces overheating of the asphalt.

4 Claims, 2 Drawing Figures

SYSTEM FOR COMBINING MULTIPLE FUELS TO PRODUCE CONTROLLABLE GAS TEMPERATURES IN ASPHALT DRUM MIXERS

BACKGROUND OF THE INVENTION

This application is a continuation-in-part of application Ser. No. 127,643, filed Mar. 6, 1980, entitled "System for Controlling Gas Temperatures in Asphalt Drum Mixers", and assigned to the assignee of the present application.

The present invention relates generally to an improved system for gas temperature control and, particularly, to a method for the regulation of burner temperatures in a rotatable dryer drum of a conventional or recycling asphalt drum mixer in which a series of fuels can be burned efficiently. Burner control results in predictable combustion gas temperatures within the dryer drum, and the simultaneous combustion of several fuels permits the use of fuels which are ordinarily difficult to burn.

A drum mixer of the type here under consideration employs a gas or oil fueled burner at an input end. As the dryer drum rotates, aggregate and fresh asphalt are combined in the drum; the aggregate is heated and dried by hot gases generated by the burner while asphalt is added to the lower half of the drum. The drum includes internal vanes for lifting the aggregate and allowing it to drop through the hot gases as it proceeds from the input end to a discharge end of the drum. If the hot gases are not cooled sufficiently before the asphalt is added to the lower half of the drum, overheating of the asphalt may occur to produce asphalt particulate emissions or blue smoke.

Reclaimed asphalt pavement can also be combined with the aggregate-liquid asphalt mixture. The introduction of reclaimed asphalt to the drum mixer, however, results in an even greater emission problem. The elevated temperatures necessary to heat the reclaimed material can cause a severe overheating of the asphalt and thereby increase the concentration of particulates generated. In addition, exposure of the asphalt to high temperatures increases the possibility of oxidizing and degrading the final product.

Therefore, the need exists for a method to control heating temperatures and to minimize smoke production while a temperature sufficient to heat the aggregate and soften reclaimed solid asphalt is maintained. The invention of the present application as referred to above is directed to the solution of the problem.

However, another problem exists. Since fossil fuels are becoming more scarce and expensive, alternative energy sources must be considered. Other fuels, such as heavy oils, waste oils and propane, may be used; but the simultaneous burning of two or more such fuels is difficult since the heavier and waste fuels do not adequately support combustion. A device is needed which will control air to fuel ratios when several fuels are in simultaneous use. The present invention is directed to the solution of these problems.

SUMMARY OF THE INVENTION

In the present invention, desired combustion temperatures at the flame are obtained by regulation of the mass of air and of each fuel which flows to the burner of a drum mixer. Control of the flame temperature facilitates control of the temperatures near the drum midpoint where the fresh or reclaimed asphalt is introduced, and can be easily overheated. The method of controlled fuel and air flow in high temperature combustion significantly reduces, if not eliminates, the production of smoke, and at a moderate cost.

Fuel and air mass flow rates are measured; the combustion reaction components are combined according to a predetermined ratio. Each rate of fuel flow to the burner is measured by a turbine meter, or any other suitable flow device, while the rate of air flow is measured by a meter at an inlet orifice. The ratio of the multiple flow rates determines the flame temperature. Volume flow rates are converted to mass flow rates by applying specific gravity. Components in a combustion reaction combine on a mass basis, making the volume to mass conversion important before proportioning is performed.

Under preferred conditions, however, the air flow is regulated relative to each rate of fuel flow. Control of the mass of air introduced to the burner can be accomplished by means of a fan and a damper arrangement. The controlled total fuel mass to air mass ratio produces predictable and reproducible temperatures at the burner and throughout the system. The invention has the additional advantage of increasing the fuel efficiency of the drum mixer since the fuel/air ratio required to reach the optimum temperature for a given fuel is predictable and controllable.

Control may be either manual or automatic. If automatic means are used, the desired ratio of each fuel to air is communicated to a control mechanism which monitors the mass flow rate of either component and adjusts the mass flow rate of the other component to maintain the necessary operating temperature for the particular drum mixer.

It is the principal object of this invention to provide a method for supplying a burner of an asphalt drum mixer with air and a combination of fuels in a predetermined ratio to reduce the overheating of the asphalt and to avoid the production of smoke. Fuels are selected according to availability; fuel ratios can be adjusted to that ratio which represents the most economical blend while maintaining stable combustion. In addition, an asphalt-aggregate mixture can be heated to the required temperature with maximum allowable heat transfer while the production of significant levels of hydrocarbon emissions is prevented.

It is a further object of this invention to increase the fuel efficiency of the asphalt drum mixer. The mass of air required for a given combination of fuels to reach and maintain the most efficient temperature within the drum is predictable and controllable.

Other objects and advantages will be apparent from the following description made with reference to the accompanying drawings.

DETAILED DESCRIPTION

The present invention has particular application for controlling temperatures within an asphalt drum mixer of the type disclosed in the co-pending application of Lee V. Binz, Ser. No. 039,383, filed May 16, 1979, and assigned to the assignee of the present application. The specification and drawings of the aforesaid application are incorporated herein by reference.

Figure 1:
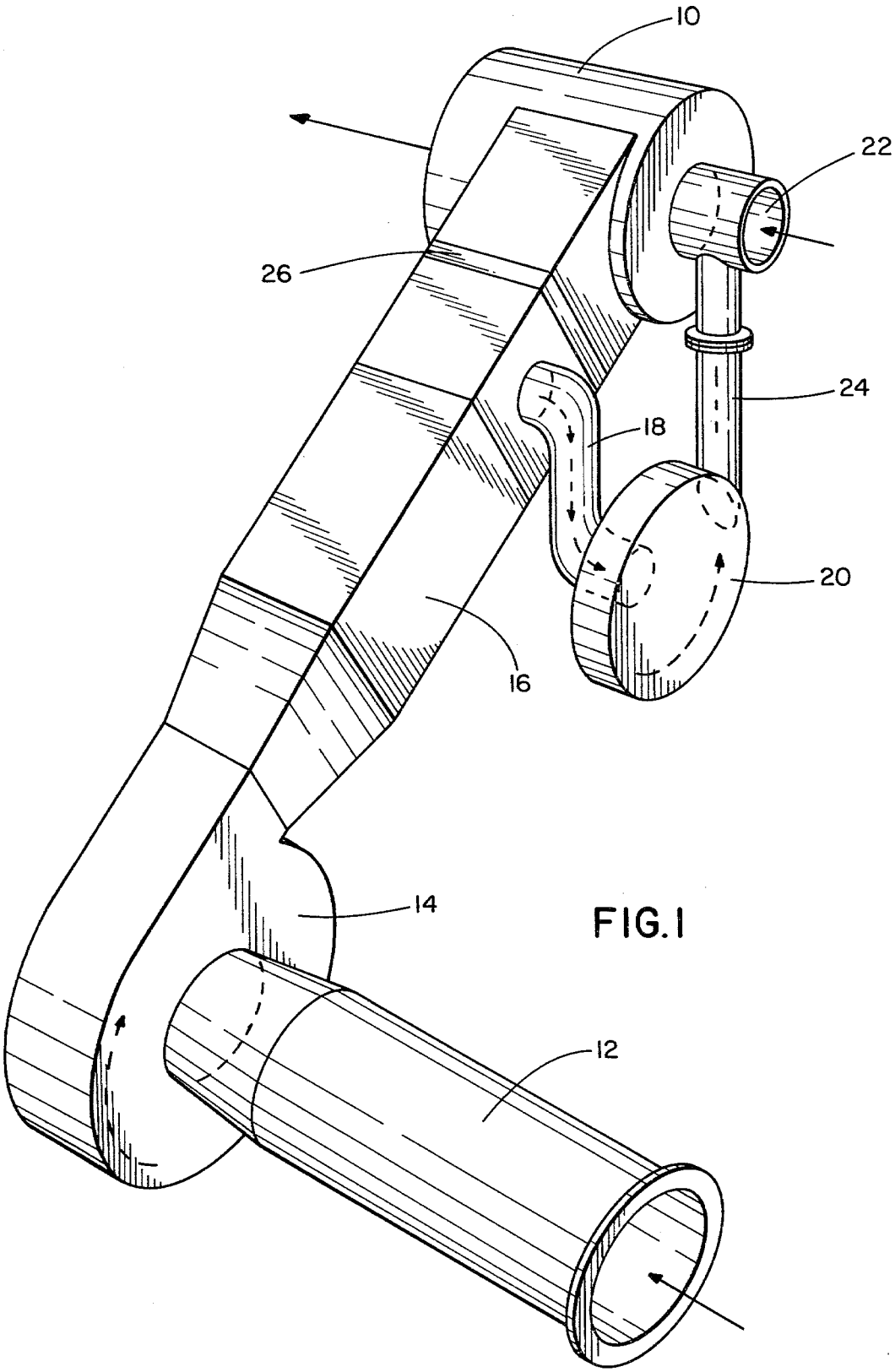
FIG. 1 is an isometric view of a gas burner of a conventional drum mixer for use in the invention.

Referring to FIG. 1 of the present application, a conventional burner 10 is used in carrying out the method of this invention. An air inlet tube 12 is in communication with a fan 14. The fan is connected via ducting 16 and tubing 18 with a turbo blower 20 which increases the air velocity to atomize the fuel at a fuel inlet 22. A quantity of air is used to atomize the fuel in this manner. Tubing 24 connects the turbo blower 20 with the fuel inlet 22. A damper 26 is provided to control the additional quantity of air needed for combustion. Approximately one-fourth of the air required for combustion passes through the turbo blower 20 and through tubing 24 for use in atomizing. The remainder flows through damper 26 and directly to the burner.

In standard practice, a predetermined quantity of air passes through inlet 12 and, after passing through the fan 14, flows via ducting 16; a portion flows through tubing 18 to the turbo blower 20, while the remainder flows through damper 26. A constant quantity of air is introduced through the turbo blower 20, and the remainder is controlled by damper 26 so that the total quantity of air delivered is, in effect, controlled by the damper 26. The air-fuel mixture is then ignited at the burner 10 which is mounted at the inlet end of the drum mixer.

Alternatively, the quantity of air flowing through turbo blower 20 could flow independently from the ambient atmosphere into the turbo blower after measurement by a separate orifice device. The sum of the two flow rates, through orifice 12 and through the turbo blower orifice, would reflect the total air flow.

Figure 2:
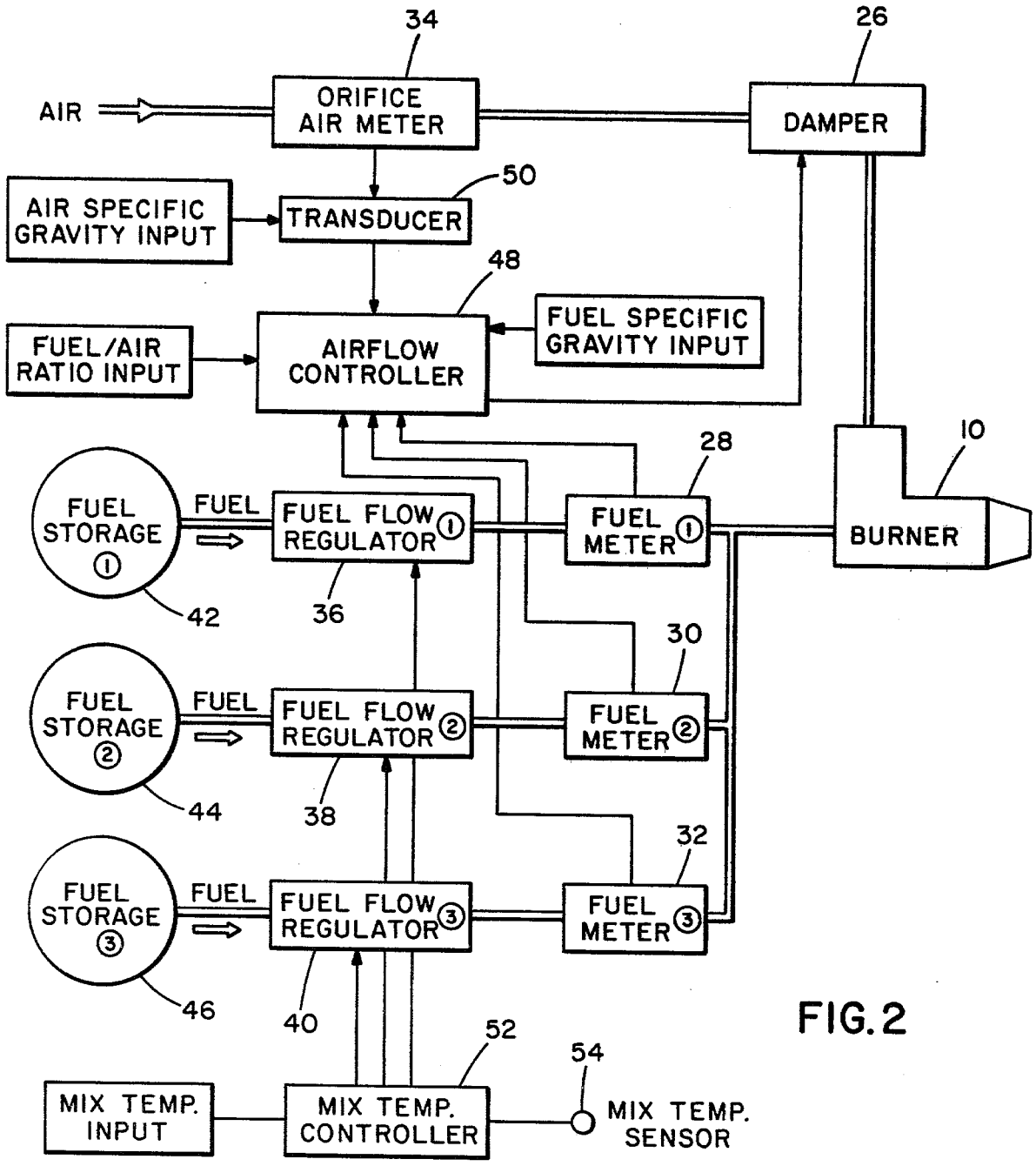
FIG. 2 is a block diagram of the apparatus used to carry out the method of the invention.

Turning now to FIG. 2, the burner 10 is shown to be in communication with the damper 26 and turbine fuel meters 28, 30 and 32. The damper 26 is also connected to an orifice air meter 34 which measures the volume of air flowing into the system. Fuel flow regulators 36, 38 and 40, which are fuel valves such as Hauck Model G-1-29s, are connected to the fuel meters 28, 30 and 32 and fuel storage tanks 42, 44 and 46, respectively.

Each fuel storage tank can contain a different fuel. If, as illustrated in FIG. 2, three storage tanks are used, each tank can store one of the following fuel types: a heavy oil, a waste oil or a hydrocarbon gas, such as propane. Indeed, any of the following liquid fuels could be used in accordance with current availability: commercial fuel oil (Grades 1–6) gasoline, kerosene, alcohol, waste oil, bunker fuel, asphalt, kerogen, crude oil, liquified coal and coal/oil slurry. The use of solid and gaseous fuels including powdered coal, butane, propane and natural gas is also contemplated. It will, of course, be understood that any combination of individual fuel storage tanks could be used.

An airflow controller 48 (e.g., a Honeywell Model R7352 or a Barber-Colman Model 560) is in communication with a transducer 50, the damper 26 and each fuel meter 28, 30 and 32. The transducer 50 is also in communication with the air meter 34 and functions to transform the air pressure signal from the air meter 34 into an electronic signal for relay to the controller 48. A suitable transducer is a Viatran Model 506. In addition, a conventional asphalt mix temperature controller 52 is connected with each fuel flow regulator 36, 38 and 40 and an asphalt mix temperature sensor 54. The mix temperature controller 52 and sensor 54 are located at the end of the drum where the asphalt-aggregate mix is discharged. Under normal operating conditions, the temperature of the mix when discharged from the drum is less than 300° F.

In the preferred practice of the invention, air flows through the orifice air meter 34 and is regulated by the damper 26. The air then passes to the air inlet tube 12 of the burner 10 as illustrated in FIG. 1. The fuels, on the other hand, flow from the fuel storage tanks 42, 44 and 46 to the fuel flow regulators 36, 38 and 40, respectively, before passing through the fuel meters 28, 30 and 32 and entering the burner 10 at the fuel inlet 22.

The desired total fuel to air ratio is manually selected by means of air to fuel ratio inputs to the controller 48 which, as described, regulates the air flow relative to the total fuel flow via manipulation of the damper 26. Thus, in standard operation the total rate of fuel flow is relatively constant and the rate of air flow is varied. The controller 48, by means of the transducer 50, electronically matches the rates of fuel and air flow to the previously selected ratio. If the actual total fuel to air ratio does not correspond to the selected value, the controller 48 automatically adjusts the damper 26, and thus, the air flow, to produce the desired total ratio of fuel to air.

The controller 48 must be capable of determining the mass of air needed to burn the mass of each fuel, add the air masses to determine the total quantity of air required for efficient combustion and control the air flow relative to the total required air supply. The ratios of each fuel to total fuel flow can be controlled by controller 52 in communication with each fuel regulator 36, 38 and 40 so that the most economical fuel blend within the constraints of availability and flame stability is achieved.

At the same time the total fuel to air ratio is selected, the desired mixture temperature is set in the mixture temperature controller 52, which is connected to the mixture temperature sensor 54 and the fuel flow regulators 36, 38 and 40. Since the mixture temperature and the fuel to air ratios are predetermined, the rate of air flow is easily regulated relative to a given fuel flow to maintain the necessary ratio to reach the required combustion gas temperature.

The method may, of course, be modified for operation with a variety of fuels and for use with drum mixers of different configurations. Therefore, it will be understood that various changes and modifications may be made in the above described apparatus and method without departing from the spirit thereof, particularly as defined in the following claims.

We claim:

1. A method for heating an asphalt-aggregate composition in a drum mixer by utilizing two or more fuels of different types to supply the burner, said method comprising the steps of:

(a) supplying combustion air to the burner of a drum mixer;

(b) measuring the mass flow rate of the air to the burner;

(c) supplying two or more fuels of different properties for combustion within the burner;

(d) measuring the mass flow rate of each of said fuels to said burner during combustion;

(e) mixing the air with each of said fuels in predetermined ratios;

(f) heating the asphalt by means of combustion gases produced by said burner; and (g) utilizing the aforesaid measurements for controlling electronically the ratio of each fuel to air to maintain a predictable and controllable combustion gas temperature within the range of 1600 to 3200 degrees Fahrenheit in said drum mixer.

2. A method in accordance with claim 1 including the additional step of sensing the temperature produced within said drum mixer by the combustion gases.

3. A method in accordance with claim 1 further including the step of supplying gaseous, liquid and solid fuels to said burner.

4. A method in accordance with claim 1 wherein the ratio of each fuel to air is automatically controlled.

* * * * *